US009290965B2

(12) United States Patent
Hickman

(10) Patent No.: US 9,290,965 B2
(45) Date of Patent: Mar. 22, 2016

(54) LOCK ASSEMBLY HAVING QUICK RELEASE DOUBLE FIRE PLATE

(71) Applicant: Stanley Security Solutions, Inc., Indianapolis, IN (US)

(72) Inventor: Chad A. Hickman, Rensselaer, IN (US)

(73) Assignee: Stanley Security Solutions, Inc., Indianapolis, IN (US)

( * ) Notice: Subject to any disclaimer, the term of this patent is extended or adjusted under 35 U.S.C. 154(b) by 334 days.

(21) Appl. No.: 14/105,683

(22) Filed: Dec. 13, 2013

(65) Prior Publication Data

US 2014/0165671 A1 Jun. 19, 2014

Related U.S. Application Data

(60) Provisional application No. 61/738,980, filed on Dec. 18, 2012.

(51) Int. Cl.

*E05B 15/00* (2006.01)
*E05B 15/16* (2006.01)
*E05B 47/00* (2006.01)

(52) U.S. Cl.

CPC ..... *E05B 15/16* (2013.01); *E05B 15/00* (2013.01); *E05B 47/0012* (2013.01); *Y10T 70/5199* (2015.04); *Y10T 70/7062* (2015.04)

(58) Field of Classification Search

CPC ..... E05B 15/00; E05B 15/16; E05B 47/0012; E05B 65/104; Y10T 70/5199; Y10T 70/7062; Y10T 292/85; Y10T 292/91; Y10T 292/96; Y10T 70/8568

USPC ..... 70/218, 92, 422, 451, 465, 466; 292/92, 292/DIG. 65, DIG. 66

See application file for complete search history.

(56) References Cited

U.S. PATENT DOCUMENTS 2,250,787 A * 7/1941 Anderson ..... F16B 37/00 711/433
3,881,331 A * 5/1975 Tranberg ..... E05B 59/00 70/107
3,990,277 A * 11/1976 Mullich ..... E05B 59/00 292/34
4,003,593 A * 1/1977 Wilzig ..... E05B 65/104 292/165
4,055,361 A * 10/1977 Moses ..... E05B 13/004 292/359
4,145,900 A * 3/1979 Ohno ..... E05B 65/104 292/92
4,161,804 A * 7/1979 D'Hooge ..... A62C 2/12 16/48.5
4,311,329 A * 1/1982 Kral ..... E05B 65/104 292/92
4,453,753 A * 6/1984 Fayerman ..... E05B 65/104 292/169
4,502,720 A * 3/1985 Fayerman ..... E05B 65/104 292/169.16
4,986,583 A * 1/1991 Campbell ..... E05B 65/104 292/165
5,104,164 A * 4/1992 Sieg ..... E05B 17/2092 292/336.3

(Continued)

*Primary Examiner* — Suzanne Barrett
(74) *Attorney, Agent, or Firm* — Richard J. Veltman; Adan Ayala

(57) ABSTRACT

A lock assembly includes a mounting fire plate configured for attachment to the door. A first lockset includes a lockset fire plate and a first operator assembly having a first operator handle. The first operator assembly is mounted to the lockset fire plate. At least one fusible link is configured to releasably couple the lockset fire plate of the first lockset to the mounting fire plate. The at least one fusible link is configured to melt during a fire condition to release the lockset fire plate from the mounting fire plate to facilitate a separation of the first lockset including the lockset fire plate from the mounting fire plate and the door by force of gravity.

20 Claims, 7 Drawing Sheets

(56) References Cited

U.S. PATENT DOCUMENTS 5,464,259 A * 11/1995 Cohrs ..... E05B 65/1006 292/92
5,490,700 A * 2/1996 Zuckerman ..... E05B 17/0075 292/350
5,588,686 A * 12/1996 Riley ..... E05B 65/104 292/21
6,009,732 A * 1/2000 Haeck ..... E05B 17/06 292/92
6,581,423 B2 * 6/2003 Lin ..... E05B 47/0692 292/DIG. 27
6,886,871 B1 * 5/2005 Shen ..... E05B 17/0075 292/336
8,191,939 B2 * 6/2012 Lin ..... E05B 65/104 292/1
8,702,132 B2 * 4/2014 Tien ..... E05B 65/104 292/219
8,881,637 B2 * 11/2014 Leites ..... F16B 31/005 137/75
8,979,143 B1 * 3/2015 Lin ..... E05B 17/2034 292/153

* cited by examiner

LOCK ASSEMBLY HAVING QUICK RELEASE DOUBLE FIRE PLATE

CROSS-REFERENCE TO RELATED APPLICATIONS

This is a non-provisional application based upon U.S. provisional patent application Ser. No. 61/738,980, entitled "LOCK ASSEMBLY HAVING QUICK RELEASE DOUBLE FIRE PLATE", filed Dec. 18, 2012, from which priority is claimed, and which is incorporated herein by reference in its entirety.

BACKGROUND OF THE INVENTION

1. Field of the Invention

The present invention relates to door locks, and, more particularly, to a lock assembly having a quick release double fire plate.

2. Description of the Related Art

Some doors and associated lock assemblies, such as those used in commercial buildings, are designed to aid in protecting against the spread of fire by preventing the passage of fire from one room to another. In order to do so, a lock assembly may be designed to ensure that the associated door is maintained in a closed and latched state in the event of fire. In some such lock assemblies, pivot joints in the lock actuation linkage may be designed with internal fusible links which may be melted at fire temperatures to render the lock actuation linkage nonfunctional, and thus the door remains latched. However, in such a design it may be difficult to determine by direct observation whether the lock assembly has been rendered nonfunctional.

What is needed in the art is a lock assembly configured to aid in preventing the spread of fire by providing a lock assembly having a quick release double fire plate. The present invention provides such a solution.

SUMMARY OF THE INVENTION

The present invention provides a lock assembly configured to aid in preventing the spread of fire by providing a lock assembly having a quick release double fire plate.

The invention, in one form thereof, is directed to a lock assembly for use with a door. The lock assembly includes a mounting fire plate configured for attachment to the door. A first lockset includes a lockset fire plate and a first operator assembly having a first operator handle. The first operator assembly is mounted to the lockset fire plate. At least one fusible link is configured to releasably couple the lockset fire plate of the first lockset to the mounting fire plate. The at least one fusible link is configured to melt during a fire condition to release the lockset fire plate from the mounting fire plate to facilitate the separation of the first lockset including the lockset fire plate from the mounting fire plate and the door by force of gravity.

The invention, in another form thereof, is directed to a lock assembly for use with a door. The lock assembly includes a latch assembly having a retractable bolt, and a spindle that drives the latch assembly. An exterior lockset is coupled to the door. The external lockset has an exterior operator assembly, a credential reader, and an exterior operator handle. The exterior lockset is configured such that the exterior operator handle is selectively coupled to the latch assembly. A mounting fire plate is attached to an interior of the door. An interior lockset has an interior operator assembly, a control electronics module, an interior operator handle, and a lockset fire plate to which is mounted the interior operator assembly and the control electronics module. The interior operator assembly is operatively coupled to the latch assembly via the spindle. The control electronics module is electrically connected to the credential reader. The control electronics module is configured to operatively couple the exterior operator handle to the latch assembly when a valid credential is read by the credential reader. At least one fusible link is configured to releasably couple the lockset fire plate of the interior lockset to the mounting fire plate. The at least one fusible link is configured to melt during a fire condition to release the lockset fire plate of the interior lockset from the mounting fire plate, and the mounting fire plate and the lockset fire plate are configured such that the interior lockset will fall in a direction away from the door by the force of gravity to decouple the interior lockset from the spindle that drives the latch assembly.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate an embodiment of the invention, and such exemplifications are not to be construed as limiting the scope of the invention in any manner.

DETAILED DESCRIPTION OF THE INVENTION

Figure 1:
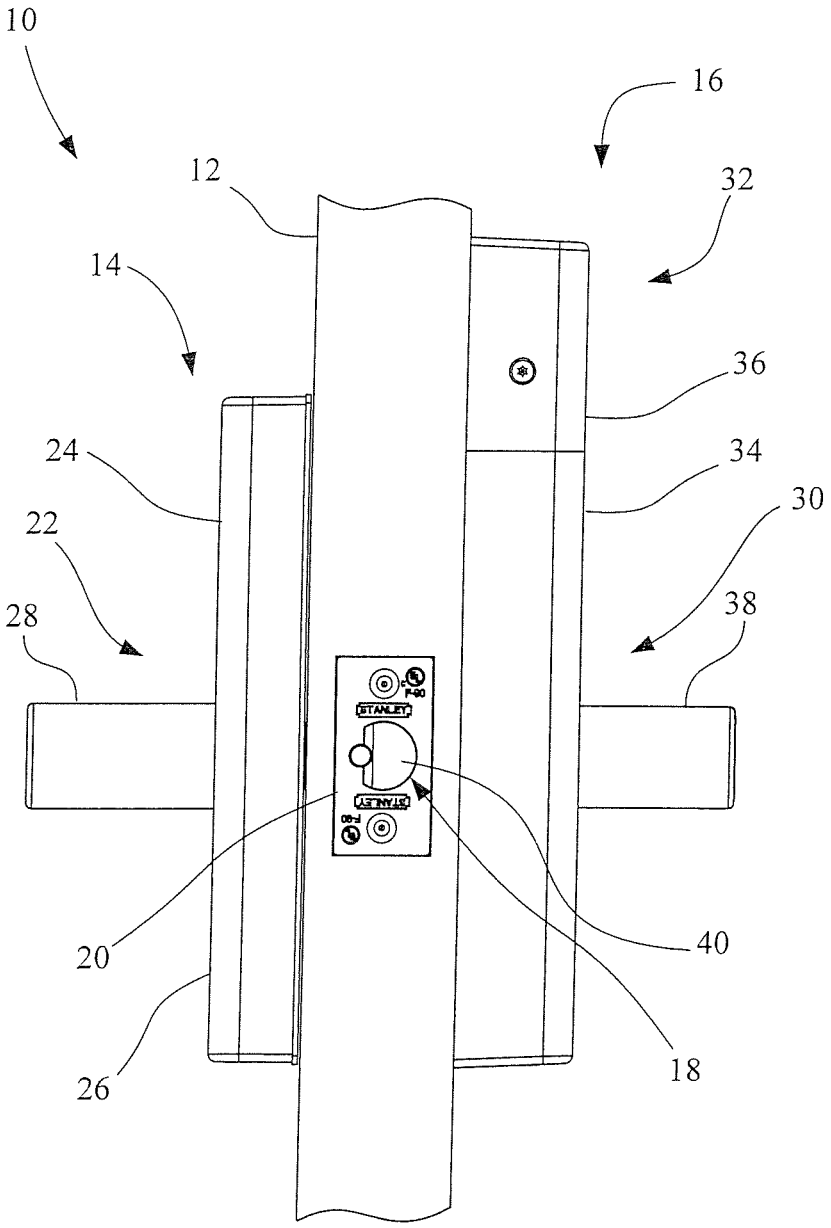
FIG. 1 is a door edge view of a lock assembly in accordance with an embodiment of the present invention, installed on a door.
Figure 2:
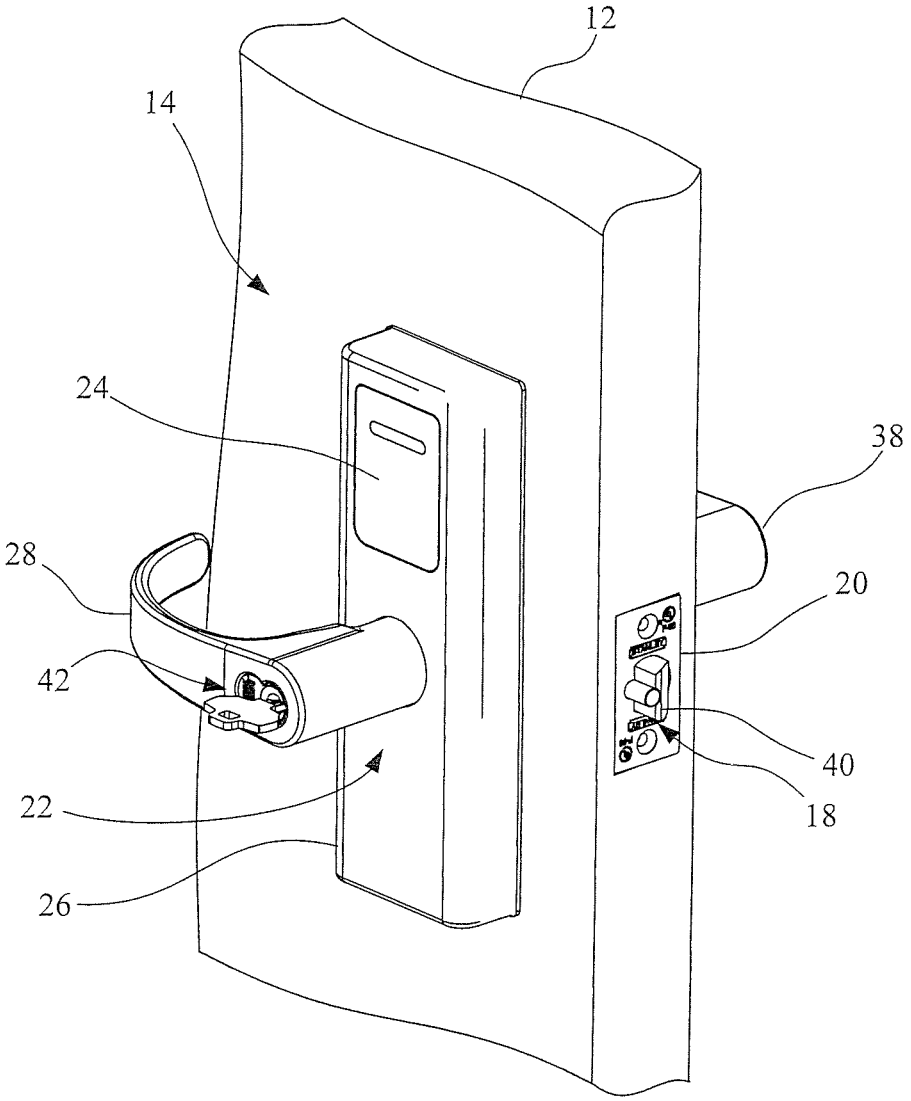
FIG. 2 is a perspective view of the exterior lockset of the lock assembly of FIG. 1, as viewed from the exterior of the door.
Figure 3:
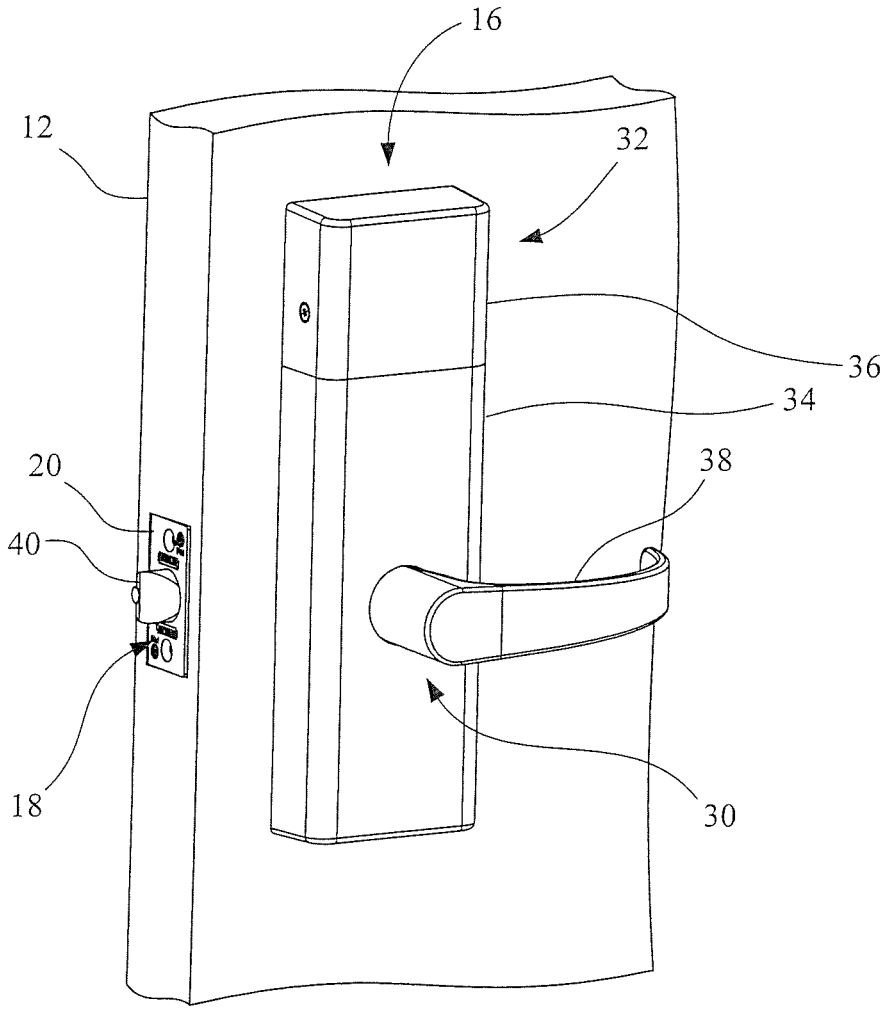
FIG. 3 is a perspective view of the interior lockset of the lock assembly of FIG. 1, as viewed from the interior of the door.

Referring now to the drawings and particularly to FIGS. 1-3, there is shown a lock assembly 10 in accordance with the present invention for mounting on a door 12, and which includes an exterior lockset 14, an interior lockset 16, a latch assembly 18, and a strike 20.

Exterior lockset 14 includes an exterior operator assembly 22, a credential reader 24, and an exterior escutcheon 26. Exterior operator assembly 22 includes an exterior operator handle 28.

Interior lockset 16 includes an interior operator assembly 30, a control electronics module 32, an interior escutcheon 34, and a battery cover 36. Interior operator assembly 30 includes an interior operator handle 38. Control electronics module 32 is electrically connected to credential reader 24 of exterior lockset 14.

As is customary in the art, latch assembly 18 is configured with a bolt actuator mechanism (not shown) and a retractable bolt 40.

Exterior lockset 14 is configured such that exterior operator handle 28 is selectively coupled to latch assembly 18. In a locked condition, exterior operator handle 28 is decoupled from latch assembly 18, and thus a rotation of exterior operator handle 28 does not result in a retraction of bolt 40. In an unlocked condition, exterior operator handle 28 is coupled to latch assembly 18, and thus a rotation of exterior operator handle 28 will result in a retraction of bolt 40.

The unlocked condition may be achieved by providing a valid credential, e.g., an RFID card, to be read by credential reader 24, which in turn sends a signal to control electronics module 32. Control electronics module 32 then compares the read credential to a database of stored authorized credentials, and if a match is found, responds by operatively coupling the exterior operator handle 28 to latch assembly 18 via a coupling mechanism (not shown). Additionally, exterior lockset 14 is provided with a mechanical override in the form of a key operated interchangeable keyed lock core 42.

Interior lockset 16 is configured such that during normal operation interior operator handle 38 is always operatively coupled to latch assembly 18, such that a rotation of interior operator handle 38 always will result in a retraction of bolt 40. However, in accordance with the present invention, interior lockset 16 is configured such that when a sufficient temperature is reached during a fire condition, then interior lockset 16 will release and fall in a direction away from door 12, and thus will be decoupled from latch assembly 18.

Figure 4:
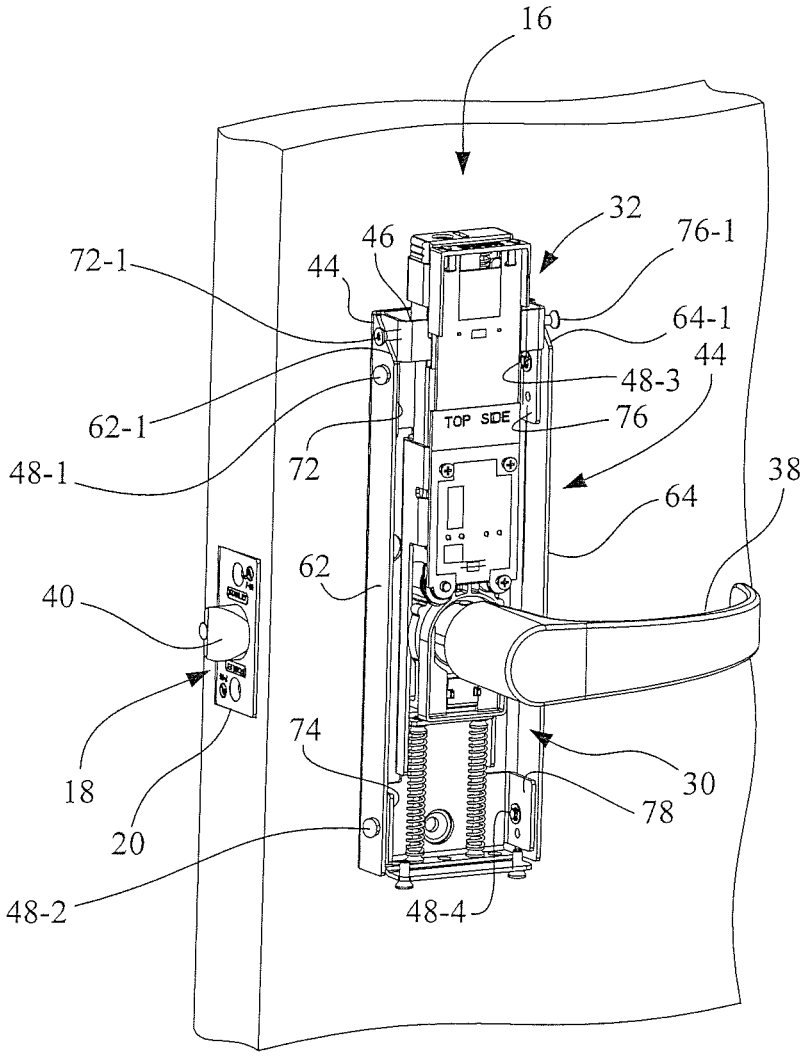
FIG. 4 is a perspective view of the interior lockset of FIG. 3, with the escutcheon and battery cover removed.
Figure 5:
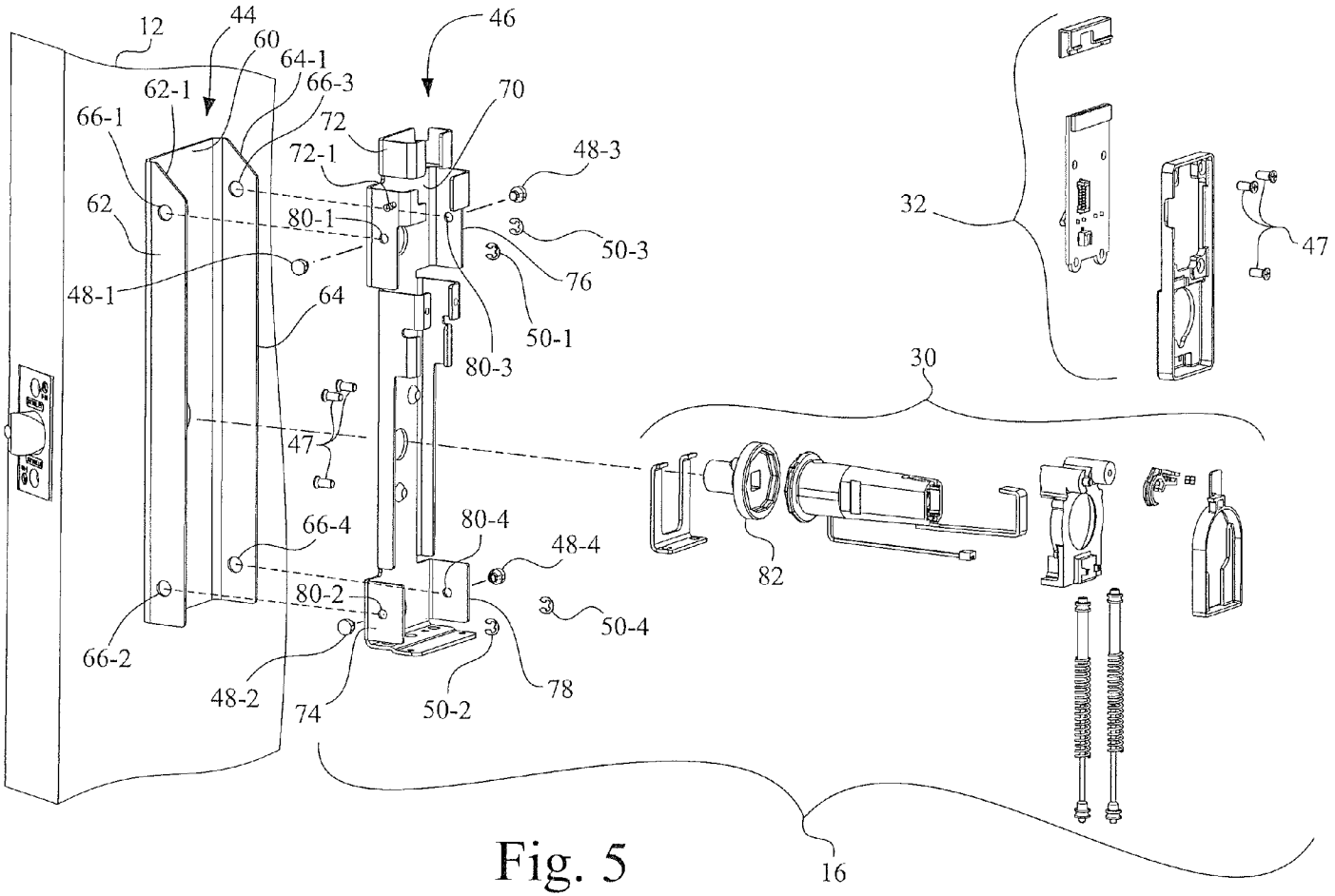
FIG. 5 is an exploded view of the interior lockset of FIG. 4, and showing the interior mounting fire plate and lockset fire plate, with the mounting fire plate attached to the door.

Referring also to FIG. 4, with reference to FIG. 3, interior escutcheon 34 has been removed to expose the internal components and connections. Referring also to FIG. 5, an interior mounting fire plate 44 is mounted to the interior side of door 12 using permanent fasteners, such as steel screws. Interior lockset 16 includes an interior lockset fire plate 46 to which is mounted the interior operator assembly 30 and control electronics module 32 via fasteners 47.

In turn, lockset fire plate 46 is mounted by a temperature sensitive releasable coupling 48 to mounting fire plate 44, wherein in the present embodiment the temperature sensitive releasable coupling 48 is a plurality, e.g., four as shown, of fusible links in the form of fusible studs collectively referenced by element number 48, and individually identified as fusible stud 48-1, fusible stud 48-2, fusible stud 48-3, and fusible stud 48-4. The combination of the mounting fire plate 44, lockset fire plate 46, and fusible studs 48 fauns a quick release double fire plate arrangement. Each fusible stud 48 is made of durable non-steel material, such as zinc, aluminum, polymer, or other non-ferrous suitable alloy, having a melting point (temperature) lower than that of mounting fire plate 44 and lockset fire plate 46. Mounting fire plate 44 and lockset fire plate 46 are made from a material, e.g., steel or similar alloy, having a higher melting point (temperature) than that of the fusible studs. Each fusible stud 48 is respectively held in position on lockset fire plate 46 with a corresponding retaining ring 50, individually identified as retaining ring 50-1, retaining ring 50-2, retaining ring 50-3, and retaining ring 50-4.

Figure 6:
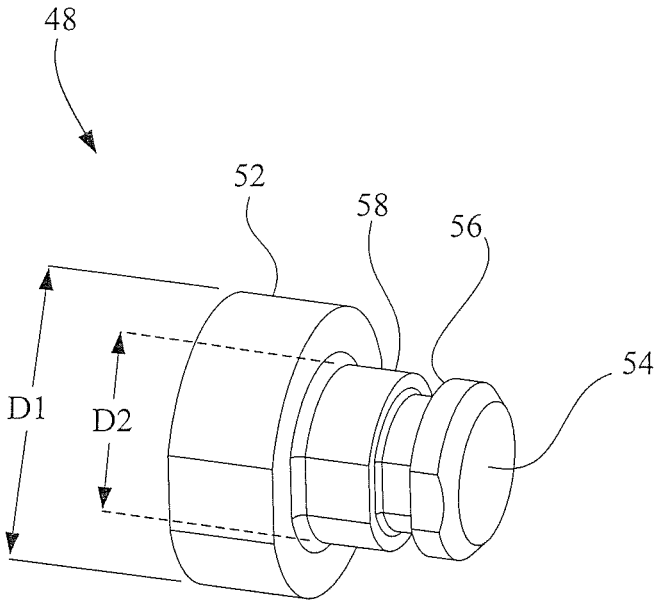
FIG. 6 is an enlarged perspective view of a fusible link stud used in mounting the lockset fire plate of the interior lockset to the mounting fire plate that is attached to the door.

Referring to FIG. 6, there is shown an exemplary fusible stud 48. Each fusible stud 48 includes a head portion 52, a shaft portion 54, and a retaining ring slot 56. A diameter D1 of head portion 52 is larger than a diameter D2 of shaft portion 54. Shaft portion 54 extends distally way from head portion 52 to define an annular shoulder 58. The retaining ring slot 56 is formed as an annular groove around shaft portion 54, with retaining ring slot 56 being axially spaced from head portion 52 to define an axial extent of shoulder 58. Retraining ring slot 56 is configured to receive a corresponding retaining ring 50 in a clip-fastener relationship.

Referring again to FIGS. 4 and 5, mounting fire plate 44 is formed as an elongate U-shaped channel that includes a base portion 60 and two side rails 62, 64 that project outwardly from base portion 60. Side rail 62 is laterally spaced from side rail 64 across the lateral extent of base portion 60. A longitudinal extent of mounting fire plate 44 is arranged to be vertical when mounting fire plate 44 is mounted on door 12. Side rail 62 includes an angled edge 62-1 positioned at an upper portion of side rail 62, which diverges outwardly and downwardly from base portion 60. Side rail 64 includes an angled edge 64-1 positioned at an upper portion of side rail 64, which diverges outwardly and downwardly from base portion 60.

Mounting fire plate 44 further includes four holes 66 configured to annularly receive the head portion 52 of respective fusible studs 48. In particular, side rail 62 includes two longitudinally spaced holes 66-1, 66-2 and side rail 64 includes two longitudinally spaced holes 66-3, 66-4. Holes 66-1, 66-2 are respectively sized to receive the head portion 52 of respective fusible studs 48-1, 48-2. Holes 66-3, 66-4 are respectively sized to receive the head portion 52 of respective fusible studs 48-3, 48-4.

Lockset fire plate 46 is formed as an elongate U-shaped channel that includes a base portion 70 and four side tabs 72, 74, 76 and 78 that project outwardly from base portion 70. Side tabs 72, 74 are laterally spaced from side tabs 76, 78 across the lateral extent of base portion 70. Side tab 72 is longitudinally spaced from side tab 74, and side tab 76 is longitudinally spaced from side tab 78. Lockset fire plate 46, including base portion 70 and side tabs 72, 74, 76 and 78, is dimensioned to be received between side rail 62 and side rail 64 of mounting fire plate 44.

Side tab 72 has an outwardly projecting elongate member 72-1, such as a screw, configured to engage in sliding contact the angled edge 62-1 of side rail 62 of mounting fire plate 44. Also, side tab 76 has an outwardly projecting elongate member 76-1, such as a screw, configured to engage in sliding contact the angled edge 64-1 of side rail 64 of mounting fire plate 44.

Lockset fire plate 46 further includes four holes 80 configured to receive the shoulder 58 of the shaft portion 54 of respective fusible studs 48. In particular, side tab 72 includes a hole 80-1 and side tab 74 includes a hole 80-2 that respectively correspond to the longitudinally spaced holes 66-1, 66-2 of side rail 62. Also, side tab 76 includes a hole 80-3 and side tab 78 includes a hole 80-4 that respectively correspond to the longitudinally spaced holes 66-3, 66-4 of side rail 64.

Each of holes 80-1, 80-2 is sized to receive the shoulder 58 of fusible stud 48-1 and fusible stud 48-2, respectively, with the remainder of the shaft portion 54 of fusible studs 48-1, 48-2 passing through the respective side tabs 72, 74 to expose the retaining ring slots 56 for receiving respective retaining rings 50-1, 50-2. Each of holes 80-3, 80-4 is sized to receive the shoulder 58 of fusible stud 48-3 and fusible stud 48-4, respectively, with the remainder of the shaft portion 54 of fusible studs 48-3, 48-4 passing through respective side tabs 76, 78 to expose the retaining ring slots 56 for receiving respective retaining rings 50-3, 50-4.

Stated differently, when assembled, side tab 72 of lockset fire plate 46 is interposed between head portion 52 of fusible stud 48-1 and retaining ring 50-1, with head portion 52 of fusible stud 48-1 projecting outwardly from lockset fire plate 46 to engage hole 66-1 of mounting fire plate 44. Likewise, side tab 74 of lockset fire plate 46 is interposed between head portion 52 of fusible stud 48-2 and retaining ring 50-2, with head portion 52 of fusible stud 48-2 projecting outwardly from lockset fire plate 46 to engage hole 66-2 of mounting fire plate 44. Side tab 76 of lockset fire plate 46 is interposed between head portion 52 of fusible stud 48-3 and retaining ring 50-3, with head portion 52 of fusible stud 48-3 projecting outwardly from lockset fire plate 46 to engage hole 66-3 of mounting fire plate 44. Side tab 78 of lockset fire plate 46 is interposed between head portion 52 of fusible stud 48-4 and retaining ring 50-4, with head portion 52 of fusible stud 48-4 projecting outwardly from lockset fire plate 46 to engage hole 66-4 of mounting fire plate 44.

In accordance with the present invention, the mounting fire plate 44/lockset fire plate 46 configuration described above provides a quick release double fire plate design that allows interior lockset 16 on the non-keyed side of door 12 to release and fall away quickly in the case of a fire. For example, each of mounting fire plate 44 and lockset fire plate 46 may be made of steel material, and are held together only with the non-steel fusible studs 48. In case of a fire, lockset fire plate 46 will be released from and will separate from mounting fire plate 44 because the non-steel fusible studs 48 melt away.

As the lockset fire plate 46 begins to fall by the force of gravity, outwardly projecting elongate members 72-1, 76-1 of lockset fire plate 46 engage and slide along angled edges 62-1, 64-1 of mounting fire plate 44 that diverge, i.e., angle downwardly, away from door 12, so as to force the upper portion of lockset fire plate 46 to move away from the door, thus separating lockset fire plate 46 with interior lockset 16 from mounting fire plate 44 and door 12. As such, referring to FIGS. 5 and 7, a spindle driver 82 of interior operator assembly 30 will decouple from the spindle 84 that drives latch assembly 18, as interior lockset 16 falls by the effects of gravity to the floor.

In addition, since control electronics module 32 of interior lockset 16 enables the operation of exterior lockset 14, once interior lockset 16 falls off of door 12, latch assembly 18 cannot be operated by either of exterior operator handle 28 or interior operator handle 38. Thus, the door 12 remains latched and closed, which helps to prevent the spread of a fire.

Figure 7:
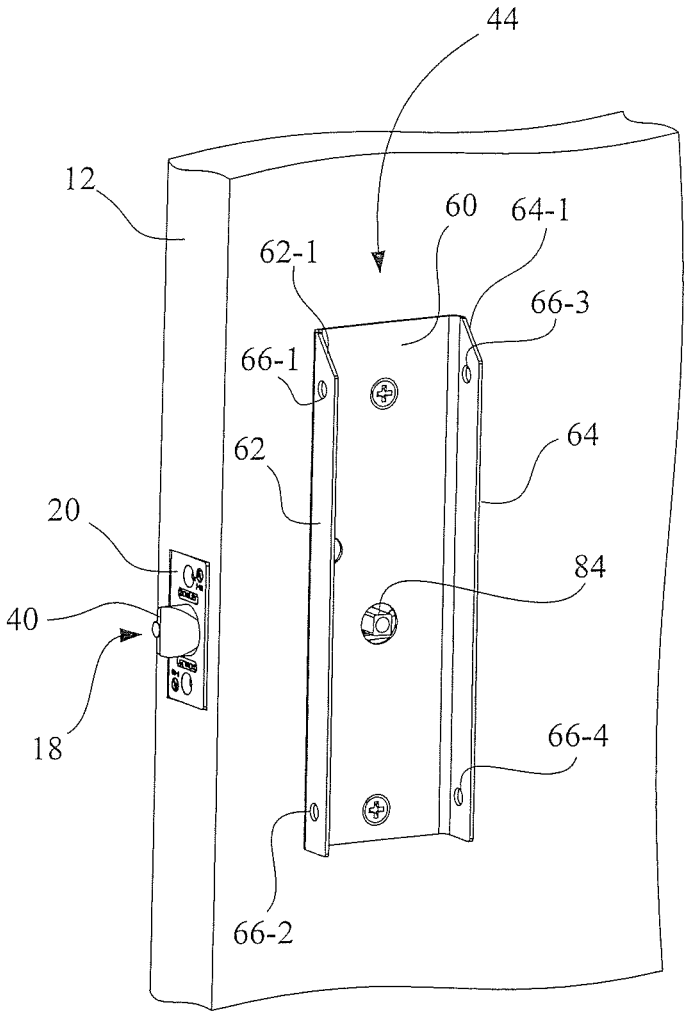
FIG. 7 is a perspective view that shows the mounting fire plate remaining attached to the door after the interior lockset has fallen away following destruction of the fusible link studs.

As shown in FIG. 7, once interior operator assembly 30 falls away, mounting fire plate 44 remains mounted to door 12, thus reducing the size of any through hole through door 12 at spindle 84. Thus, mounting fire plate 44 serves as a secondary fire plate which further helps to prevent the spread of a fire.

Thus, the present invention advantageously allows the entire lockset 16 to fall away from the door 12 quickly in the case of a fire, thus disabling the actuation of the latch assembly 18, while also allowing lockset 16 to be secure and strong during normal usage, and making it possible to determine by direct observation whether lock assembly 10 has been rendered nonfunctional.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A lock assembly for use with a door, comprising:

a mounting fire plate attachment to the door;

a first lockset including a lockset fire plate and a first operator assembly having a first operator handle, the first operator assembly being mounted to the lockset fire plate; and at least one fusible link releasably coupled to the lockset fire plate of the first lockset and to the mounting fire plate, the at least one fusible link which melts during a fire condition to release the lockset fire plate from the mounting fire plate to facilitate a separation of the first lockset including the lockset fire plate from the mounting fire plate and the door by force of gravity.

2. The lock assembly of claim 1, the mounting fire plate and the lockset fire plate being configured such that the lockset fire plate with the first lockset are moved by force of gravity in a direction away from the door after the release.

3. The lock assembly of claim 1, wherein each of the mounting fire plate and the lockset fire plate is made of a steel material, the mounting fire plate is mounted to the door by permanent steel fasteners, and the at least one fusible link is made of a non-steel material having a melting point lower than that of the mounting fire plate and the lockset fire plate.

4. The lock assembly of claim 3, wherein the non-steel material is zinc, aluminum, polymer, or other non-ferrous alloy.

5. The lock assembly of claim 1, wherein the at least one fusible link is a plurality of fusible links, each of the mounting fire plate and the lockset fire plate having a respective hole of a plurality of holes for receiving a respective fusible link of the plurality of fusible links.

6. The lock assembly of claim 5, wherein each of the plurality of fusible links is made of a non-steel material having a melting point lower than that of the mounting fire plate and the lockset fire plate.

7. The lock assembly of claim 6, wherein the non-steel material is at least one of zinc, aluminum, polymer, or other non-ferrous suitable alloy, and wherein each of the mounting fire plate and the lockset fire plate is made from a steel material having a higher melting point than that of the plurality of fusible links.

8. The lock assembly of claim 1, wherein:

the mounting fire plate includes an elongate U-shaped channel that includes a first base portion, a first side rail and a second side rail, each of the first side rail and the second side rail configured to project outwardly from the first base portion, the first side rail being laterally spaced from the second side rail across a lateral extent of the first base portion, wherein a longitudinal extent of the mounting fire plate is arranged to be vertical when the mounting fire plate is mounted on the door, the first side rail having a first angled edge positioned at an upper portion of first side rail which diverges outwardly and downwardly from the first base portion, and the second side rail having a second angled edge positioned at an upper portion of the second side rail which diverges outwardly and downwardly from the first base portion; and the lockset fire plate includes a second base portion and a plurality of side tabs that project outwardly from the second base portion, the plurality of side tabs including a first side tab laterally spaced from a second side tab across the lateral extent of the second base portion, the first side tab having a first projecting elongate member configured to engage in sliding contact the first angled edge of the first side rail of the mounting fire plate, and the second side tab having a second projecting elongate member configured to engage in sliding contact the second angled edge of the second side rail of the mounting fire plate, so as to force an upper portion of the lockset fire plate of the first lockset to move in a direction away from the door.

9. The lock assembly of claim 8, wherein the at least one fusible link is a plurality of fusible links, and each of the mounting fire plate and the lockset fire plate has a respective hole for receiving a respective fusible link of the plurality of fusible links.

10. The lock assembly of claim 1, wherein the first lockset is an interior lockset, and further comprising:

a control electronics module contained in the interior lockset;

a latch assembly, the first operator assembly of the interior lockset being configured for operative coupling to the latch assembly when the interior lockset is mounted to the door; and an exterior lockset configured for selective coupling to the latch assembly when actuated by the control electronics module of the interior lockset.

11. The lock assembly of claim 10, the mounting fire plate and the lockset fire plate being configured such that as the lockset fire plate begins to fall by gravity as the at least one fusible link is melted, an upper portion of the lockset fire plate of the first lockset is forced to move in a direction away from the door to decouple the interior lockset from the latch assembly.

12. A lock assembly for use with a door, comprising:

a latch assembly having a retractable bolt;

a spindle configured to drive the latch assembly;

an exterior lockset coupled to the door, the external lockset having an exterior operator assembly, a credential reader, and an exterior operator handle, the exterior lockset configured such that the exterior operator handle is selectively coupled to the latch assembly;

a mounting fire plate attached to an interior of the door; and an interior lockset having an interior operator assembly, a control electronics module, an interior operator handle, and a lockset fire plate to which is mounted the interior operator assembly and the control electronics module, the interior operator assembly being operatively coupled to the latch assembly via the spindle, the control electronics module being electrically connected to the credential reader, the control electronics module configured to operatively couple the exterior operator handle to the latch assembly when a valid credential is read by the credential reader, and at least one fusible link releasably coupled to the lockset fire plate of the interior lockset and to the mounting fire plate, the at least one fusible link which melts during a fire condition to release the lockset fire plate of the interior lockset from the mounting fire plate, and the mounting fire plate and the lockset fire plate are configured such that the interior lockset will fall in a direction away from the door by force of gravity to decouple the interior lockset from the spindle that drives the latch assembly.

13. The lock assembly of claim 12, wherein each of the mounting fire plate and the lockset fire plate is made of a steel material, the mounting fire plate being mounted to the door by steel fasteners, and the at least one fusible link is made of a non-steel material having a melting point lower than that of the mounting fire plate and the lockset fire plate.

14. The lock assembly of claim 13, wherein the non-steel material is at least one of zinc, aluminum, polymer, or other non-ferrous alloy.

15. The lock assembly of claim 12, wherein the at least one fusible link is a plurality of fusible links, each of the mounting fire plate and the lockset fire plate having a respective hole of a plurality of holes for receiving a respective fusible link of the plurality of fusible links, the combination of the mounting fire plate, the lockset fire plate, and the plurality of fusible links configured to form a quick release double fire plate arrangement.

16. The lock assembly of claim 15, wherein each of the plurality of fusible links is made of a non-steel material having a melting point lower than that of the mounting fire plate and the lockset fire plate.

17. The lock assembly of claim 15, wherein each of the plurality of fusible links is made of zinc, aluminum, polymer, or other non-ferrous alloy.

18. The lock assembly of claim 15, wherein each of the mounting fire plate and the lockset fire plate is made from a steel material having a higher melting point than that of the plurality of fusible links.

19. The lock assembly of claim 12, wherein:

the mounting fire plate includes an elongate U-shaped channel that includes a first base portion, a first side rail and a second side rail, each of the first side rail and the second side rail configured to project outwardly from the first base portion, the first side rail being laterally spaced from the second side rail across a lateral extent of the first base portion, wherein a longitudinal extent of the mounting fire plate is arranged to be vertical when the mounting fire plate is mounted on the door, the first side rail having a first angled edge positioned at an upper portion of first side rail which diverges outwardly and downwardly from the first base portion, and the second side rail having a second angled edge positioned at an upper portion of the second side rail which diverges outwardly and downwardly from the first base portion; and the lockset fire plate includes a second base portion and a plurality of side tabs that project outwardly from the second base portion, the plurality of side tabs including a first side tab laterally spaced from a second side tab across the lateral extent of second base portion, the first side tab having a first projecting elongate member configured to engage in sliding contact the first angled edge of the first side rail of the mounting fire plate, and the second side tab having a second projecting elongate member configured to engage in sliding contact the second angled edge of the second side rail of the mounting fire plate, wherein as the lockset fire plate begins to fall by gravity as the at least one fusible link is melted, the first projecting elongate member and the second projecting elongate member of the lockset fire plate respectively engage and slide along the first angled edge and the second angled edge of the mounting fire plate so as to cause an upper portion of the lockset fire plate of the first lockset to move in a direction away from the door to decouple the interior lockset from the spindle that drives the latch assembly.

20. The lock assembly of claim 19, wherein the at least one fusible link is a plurality of fusible links, and each of the mounting fire plate and the lockset fire plate has a respective hole of a plurality of holes for receiving a respective fusible link of the plurality of fusible links.

* * * * *